US007171711B2

(12) United States Patent
Gowda

(10) Patent No.: US 7,171,711 B2
(45) Date of Patent: Feb. 6, 2007

(54) INFLATABLE CUSHION CELL WITH DIAGONAL SEAL STRUCTURE

(75) Inventor: Raj K. Gowda, Corona, CA (US)

(73) Assignee: Kap Medical, Corona, CA (US)

( * ) Notice: Subject to any disclaimer, the term of this patent is extended or adjusted under 35 U.S.C. 154(b) by 0 days.

(21) Appl. No.: 10/700,173

(22) Filed: Nov. 3, 2003

(65) Prior Publication Data

US 2005/0091752 A1 May 5, 2005

(51) Int. Cl.
*A47C 27/10* (2006.01)
*A47C 27/08* (2006.01)

(52) U.S. Cl. ..... 5/713; 5/655.3; 5/932; 5/710

(58) Field of Classification Search ..... 5/710, 5/713, 644, 655.3, 932, 712, 715, 706
See application file for complete search history.

(56) References Cited

U.S. PATENT DOCUMENTS 1,726,939 A * 9/1929 Anderson ..... 267/117
2,728,926 A * 1/1956 Emery ..... 5/644
4,161,794 A * 7/1979 Darnfors ..... 5/644
5,251,349 A 10/1993 Thomas et al.
5,774,917 A * 7/1998 Liu ..... 5/715

* cited by examiner

*Primary Examiner*—Alexander Grosz
(74) *Attorney, Agent, or Firm*—Vedder, Price, Kaufman & Kammholz, P.C.

(57) ABSTRACT

An inflatable cushion cell has first and second inflatable compartments. Each inflatable compartment is defined by at least one diagonal seal structure. In addition, each inflatable compartment also has at least one fluid opening. In one embodiment the diagonal seal structure is offset from opposite corners of the inflatable cushion cell. In one embodiment patient support system includes a plurality of inflatable such cushion cells are located within a frame. In one embodiment a pressure control system is used control the inflation of the first and second inflatable compartments. In one embodiment a method is used to move a patient in an inflatable patient support system.

23 Claims, 4 Drawing Sheets

INFLATABLE CUSHION CELL WITH DIAGONAL SEAL STRUCTURE

FIELD OF THE INVENTION

The invention relates generally to mattresses designed for use with patients, and more particularly, to mattresses designed for use with patients that contain inflatable cells which can be selectively inflated or deflated.

BACKGROUND OF THE INVENTION

Both patients and patient service providers benefit from products that provide features that increase therapeutic effectiveness, provide additional benefits, provide greater patient comfort and/or reduce patient cost. Part of the patient care services provided by patient service providers includes the administering of certain therapies while a patient is in bed. Such therapies include those that are directly related to the damage caused to the skin of a patient due to long periods of time spent in bed. For example, moving the patients, while in bed, can help prevent, as well as cure, bed sores (decubitus ulcers). In addition, reducing the pressure that the bed exerts on the patient's skin can also help prevent, or cure, bed sores. This can be achieved by providing an inflatable mattress where the weight of a patient can be distributed over a wider area and therefore the pressure on the patient's skin can be greatly reduced, as compared with the pressures exerted by conventional mattresses. The reduced pressure allows greater blood supply to the patient's skin and thus helps to avoid capillary occlusion and the potentially resulting bed sores. Pressures below 32 mmHg have been shown to reduce the occurrence of bed sores. Further, even greater pressure relief may be achieved where the mattress contains multiple inflatable cells and where the pressure in each cell, or group of cells, can be independently controlled.

Additional therapies that such providers provide to patients while the patients are in bed, include, for example, those therapies related to treating respiratory complications such as pulmonary therapy, alternating therapy, pulsation therapy, low air loss therapy, static pressure therapy or the like. Such therapies cause the movement of the patients while in bed for the purpose of loosening up fluids in the patient's lungs. Here, the weight of the patient is shifted to help loosen up such fluids.

Currently, mattresses containing inflatable cells are available which allow for the controlled inflation and deflation of selected cells for the purpose of assisting patient service providers in shifting the weight of the patient. In one example, a group of right side sub-cell(s) and left side sub-cell(s) are inflated or deflated together to cause the reduction in pressure in the entire left hand side of the bed or the right hand side of the bed, respectively. Where one side of the bed remains fully, or near fully inflated, and the other side is deflated, all or partially, a relatively steep drop off, or uneven slope, is experienced between the two sides making for a less than ideal sloping surface. As designed, internal walls are used inside the inflatable cell to segregate the sub-cells from one another.

In another example, multiple inflatable cells are lined up in a series across the width of the bed and are capable of being individually inflated or deflated. Each cell of the mattress is rectangular, and as such, contain six substantially rectangular planar sides including: a top side, a bottom side, a near vertical side, a far vertical side, a left vertical side and a right vertical side. Within the cell is located four sub-cells or compartments, each being separated from an adjacent sub-cell by an internal rectangular wall. A total of three internal rectangular walls are located inside the cell. On the far outside edges of the cells are located vertical end sub-cells that act as side barriers to prevent the patient from rolling off the mattress. In the middle of the bed, and taking up the width of the bed less the vertical end sub-cells, are upper and lower sub-cells separated by a diagonal internal wall. Here, each vertical end sub-cell is in fluid communication with one of the two middle sub-cells. As designed, nine walls are required, both internal and external, to construct this example of a cell. Along with the multiple internal and external walls, is included the inherent manufacturing, design, testing and shipping costs involved with the production and distribution of the mattress.

BRIEF DESCRIPTION OF THE DRAWINGS

The invention will be more readily understood with reference to the following drawings wherein like reference numbers represent like elements and wherein.

DETAILED DESCRIPTION OF THE PREFERRED EMBODIMENT

Figure 1:
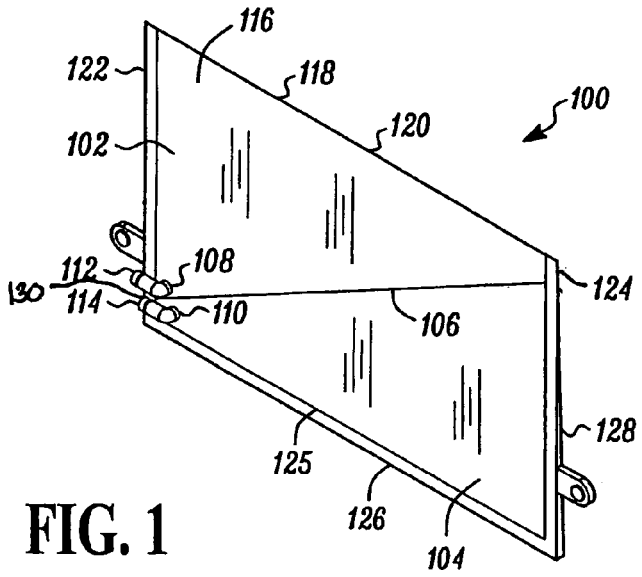
FIG. 1 is a side perspective view of an inflatable cushion cell, in accordance with one embodiment of the invention.

Briefly, an inflatable cushion cell has first and second inflatable compartments. Each inflatable compartment is defined at least in part by at least one diagonal seal structure. In addition, each inflatable compartment also contains at least one fluid opening.

As used herein, the term diagonal seal structure includes to an attachment of two or more surfaces in a manner that provides a tight closure as to provide a fluid resistant barrier to the passage of fluids. The diagonal seal structure can include one or more attachment areas of the two surfaces. For example, several consecutive individual seals can constitute a diagonal seal structure. A diagonal seal structure can include the heat sealing (e.g., radio frequency (RF) welding), gluing, fusing, welding, bonding, sewing or other suitable attachment of two materials together to form a fluid resistant bond.

Another embodiment uses more than two inflatable compartments. In such an embodiment each inflatable compartment is separated from the next by a diagonal seal structure. Further, each such inflatable compartment has a corresponding fluid opening.

A fluid opening provides a fluid communication between the internal area defined by a particular inflatable compartment such that fluids (e.g., air, water, or other suitable fluid) may be exchanged into and out of such inflatable compartment. For example, an inflation/deflation stem may extend from a boundary of an inflatable compartment wherein one end of the stem is sealed to such boundary, and where a hole in the boundary exists within the stem such that fluid may be exchanged from inside the inflatable compartment, through the hole, through the stem, with a location outside the inflatable compartment.

In one embodiment, each compartment is further defined by first and second external side walls. In such an embodiment, the diagonal seal structure connects the first and second external side walls together. The diagonal seal structure forms an internal barrier between the first and second inflatable compartments. In this embodiment, it is the seal that forms the barrier between the two compartments. As such, whether the compartments contain a comparatively low pressure, near ambient, or a comparatively high pressure, typically not exceeding 40 mmHg, the seal generally maintains a constant formation. This is in contrast to the walls that extend away from such diagonal seal structure, which, in one embodiment, extend outwardly, in a balloon like manner, as the corresponding inflatable compartment fills with a fluid. In this embodiment, the diagonal seal structure location where the two external side walls are connected, maintains the close seal relationship between the two walls regardless as to whether one or both of the inflatable compartments contain a high pressure.

As used in this embodiment, an external wall refers to the material that forms the external barrier of the two inflatable compartments. Such external walls can be made out of a variety of fluid resistant materials. As known in the art, such fluid resistant materials include: sheet vinyl or synthetic fabrics such as nylon or any blends such as PVC/nylon or vinyl/nylon or any other suitable fluid resistant material. Such walls may be treated with a fluid resistant compound on one or more sides to provide its fluid resistant properties. Such compounds include such fluid resistant materials as urethane or other suitable compounds that may be applied to nylon or other suitable materials.

An advantage, among others, provided by one embodiment is the use of a seal between external walls to define the inflatable compartments. In one embodiment a seal, attaching the two external walls, add little or no width to the walls themselves. In another embodiment, the seal, attaching the two external walls, results in the outside of the external walls residing substantially adjacent one another in comparison to other portions of the external walls that are inflated outward when such corresponding inflatable compartments are fully or partially inflated. In one embodiment, entire inflatable compartments are defined by such seals. In one embodiment, the entire inflatable cushion cell is defined by two external walls and the corresponding seals. In this embodiment, there is no need to provide any internal components to the inflatable cushion cell to form and maintain multiple inflatable compartments. As such, the inflatable compartments can be defined without adding additional internal structure inside the inflatable cushion cell. The advantages of the use of such seals have a variety of benefits, including but not limited to, reduced manufacturing costs, materials costs, design costs, testing costs and shipping costs and other like benefits.

In one embodiment a restriction member is located at a location away from the diagonal seal structure. In one embodiment, such a restriction member is located such that it will restrict the expansion of the first inflatable compartment. In another embodiment, such a restriction member is located such that it will restrict the expansion of the second inflatable compartment. The restriction member can be a number of structures that would resist the expansion of the opposing external walls of the associated inflation compartments. For example, in one embodiment the restriction member is a seal that directly attaches one external wall to the other. In another embodiment, the restriction member is one or more restriction members that bond the two external walls to one another. Another embodiment is a tension line that has two ends, one attached to one external wall and the other attached to the other external wall where the two walls are able to expand to the length of tension line, but where the walls are connected to such tension line, such portions of the wall are prevented from further expansion. One advantage provided by the restriction member is that it limits the expansion of the inflatable compartments in a width direction, and in so doing, allows for a greater height of the inflatable compartments when such compartments contain a relatively high pressure.

In one embodiment multiple inflatable cushion cells are contained in a frame. In one embodiment such inflatable cushion cells are allowed to expand and contract with little or no impact on the surrounding frame. One advantage provided by this embodiment is that the frame has little or no impact on the expansion and retraction of the inflatable cushion cells contained therein, and vice versa.

In one embodiment a fluid pump is powered on only intermittently when it is needed to change the pressure in the inflatable cushion cell. One advantage provided by this embodiment is that less energy is needed to operate the fluid pump. Another advantage is that the fluid pump generates less noise since it is not running continuously.

In one embodiment a valve assembly includes a motor and a slide valve for the purpose of controlling fluid communications with the first and second inflatable compartments. One advantage of this embodiment is that the entire combination of possible fluid communications combinations between the first and second inflatable compartments can be achieved using a single motor and a single slide valve.

FIG. 1 illustrates an inflatable cushion cell 100, having a first inflatable compartment 102, a second inflatable compartment 104, a diagonal seal structure 106, a first fluid opening 108, a second fluid opening 110. A first fluid opening stem 112 is affixed about the first fluid opening 108 and, a second fluid opening stem 114 is affixed about the second fluid opening 110. The inflatable cushion cell 100 also includes a first wall 116, and a second wall 118. The first wall 116 and the second wall 118 form the exterior portion of the inflatable cushion cell 100. Such walls are formed out of a fluid resistant material, as known in the art such that a fluid may be pumped into the first and second inflatable compartments, 102 and 104, and such walls maintain therein such fluid.

In one embodiment, fluid is provided to, and retrieved from, the first inflatable compartment 102 via the first fluid opening 108 through the first fluid opening stem 112. Likewise, fluid is provided to, and retrieved from, the second inflatable compartment 104 via the second fluid opening 110 through the second fluid opening step 114. In one embodiment, the first and second fluid opening stems, 112 and 114, are formed to receive a flexible tube thereupon. In one embodiment, a securing mechanism as known in the art (not shown) is provided such that the flexible tube can be additionally secured to the inflatable cushion cell 100. In one embodiment the first and second fluid opening stems, 112 and 114, provide a quick disconnect feature that allows for the quick and easy attachment to such flexible tube or like structure. In one embodiment the first and second fluid openings, 108 and 110, are located near one another on opposite sides of the diagonal seal structure 106 such that any fluid providing mechanisms or tubes can be located near one another. However, any suitable location may be used.

In one embodiment the diagonal seal structure 106 attaches the first wall 116 to the second wall 118 to form both the first inflatable compartment 102 and the second inflatable compartment 104. In the embodiment shown, the diagonal seal structure is represented by a single seal that directly attaches the first wall 116 to the second wall 118. The diagonal seal structure 106 forms an internal barrier that separates the two inflatable compartments 102 and 104. In one embodiment, the diagonal seal structure 106 is generated using an R/F weld. In another embodiment, the diagonal seal structure 106 is made up of several consecutive parallel seals (not shown). In another embodiment (not shown), the diagonal seal structure is wide enough to contain apertures therethrough. In yet another embodiment (not shown), the diagonal seal structure 106 may include a physical break which allows the selective separation or connection between the first inflatable compartment 102 and the second inflatable compartment 104.

In one embodiment, the first inflatable compartment 102 further includes a first inflatable compartment base 120, a first inflatable compartment first leg 122, and a first inflatable compartment second leg 124 located opposite the first leg 122. As shown, the first inflatable compartment base 120, represents the top side of the inflatable cushion cell. When the first inflatable compartment 102 contains a high pressure the first inflatable compartment first leg 122 provides the vertical rigidity to hold up the same corresponding side of the first inflatable compartment 102, and first inflatable compartment second leg 124 provides the vertical rigidity to hold up the same corresponding side of the inflatable compartment, and the first inflatable compartment base 120 maintains the rigidity to maintain its flat top base surface. It will be recognized that rounded corners or other suitable shapes may be used for the inflatable cell 100.

Similarly, the second inflatable compartment 104 further includes a second inflatable compartment base 126, a second inflatable compartment first leg 128, and a second inflatable compartment second leg 130 opposite the first leg 128. As shown, the second inflatable compartment base 126, represents the bottom side of the inflatable cushion cell 100. When the second inflatable compartment 104 contains a high pressure the second inflatable compartment first leg 128 provides the vertical rigidity to hold up the corresponding side of the second inflatable compartment 104, and the second inflatable compartment second leg 130 provides the vertical rigidity to hold up the corresponding side of the inflatable compartment, and the second inflatable compartment base 126 maintains the rigidity to maintain its flat bottom base surface.

In another embodiment the second inflatable compartment 104 is located such that the second inflatable compartment base 126 represents the top side of the inflatable cushion cell 100 and the first inflatable compartment is located such that the first inflatable compartment base 120 represents the bottom side of the inflatable cushion cell 100.

In one embodiment, the inflatable cushion 100 is substantially rectangular and contains a substantially vertical right side, a substantially vertical left side, a substantially horizontal top side and a substantially horizontal bottom side. In one embodiment, the intersection of the vertical sides and the top and bottom sides converge into four separate corners where the upper left corner is opposite the lower right corner and the lower left corner is opposite the upper right corner.

In one embodiment where a first inflatable compartment 102 contains both a first inflatable compartment first and second legs, 122 and 124, or contains both a second inflatable compartment first and second legs, 128 and 130, the diagonal seal 106 intersects such corresponding leg sides of the inflatable cushion 100 away from corner where the horizontal sides of the inflatable cushion 100 meet the corresponding vertical sides. In other words, in such an embodiment the diagonal seal 106 is located such that the diagonal seal 106 terminates along the vertical side of the inflatable cushion 100, at a distance away, or offset, from the corners of the inflatable cushion 100. However, another embodiment includes the placement of diagonal seal 106 through at least one of the corners of the inflatable cushion 100. In another embodiment the diagonal seal 106 intersects opposite corners of the inflatable cushion 100 creating first and second inflatable compartments, 102 and 104, having only one leg and one base. In yet another embodiment, the diagonal seal 106 is locates such that it intersects at least one of: the top horizontal surface and/or the bottom horizontal surface.

As shown, the inflatable cushion cell is formed such that a fluid cannot escape from its top, bottom or sides. In one embodiment, the first external wall 116 and the second external wall 118 are made out of the same flat sheet of fluid resistant material. As shown, the material is originally in one sheet and is folded over, where the fold makes up the first inflatable compartment base 120, the edge opposite the fold is sealed, via seal 125, forming the second inflatable compartment base 126, and each side is sealed forming the associated legs 122, 124, 128 and 130. In another embodiment (not shown), the first external wall 116 and second wall 118 are made out of a tubular shaped sheet of fluid resistant material. Here, the tubular shaped sheet is flattened, where the opposing folds make up the second inflatable compartment base 126 and the inflatable compartment base 120. Seals are then added, similar to seals 125, to either end of the tube to form the associated legs 122, 124, 128 and 130.

Other embodiments locate the associated folds in the location of the legs 122, 124, 128 and 130, rather than the bases 120 and 126. In yet another embodiment, the external walls 116 and 118 are initially separate sheets of fluid resistant material and are joined together via seals on each outer edge. Yet, in another embodiment, the outer edges of the inflatable cushion cell are not sealed together, but are connected together using additional external walls (not shown), which provide for expansion between the external walls 116 and 118 at such outer edges. Any other suitable structure may also be used.

Figure 2:
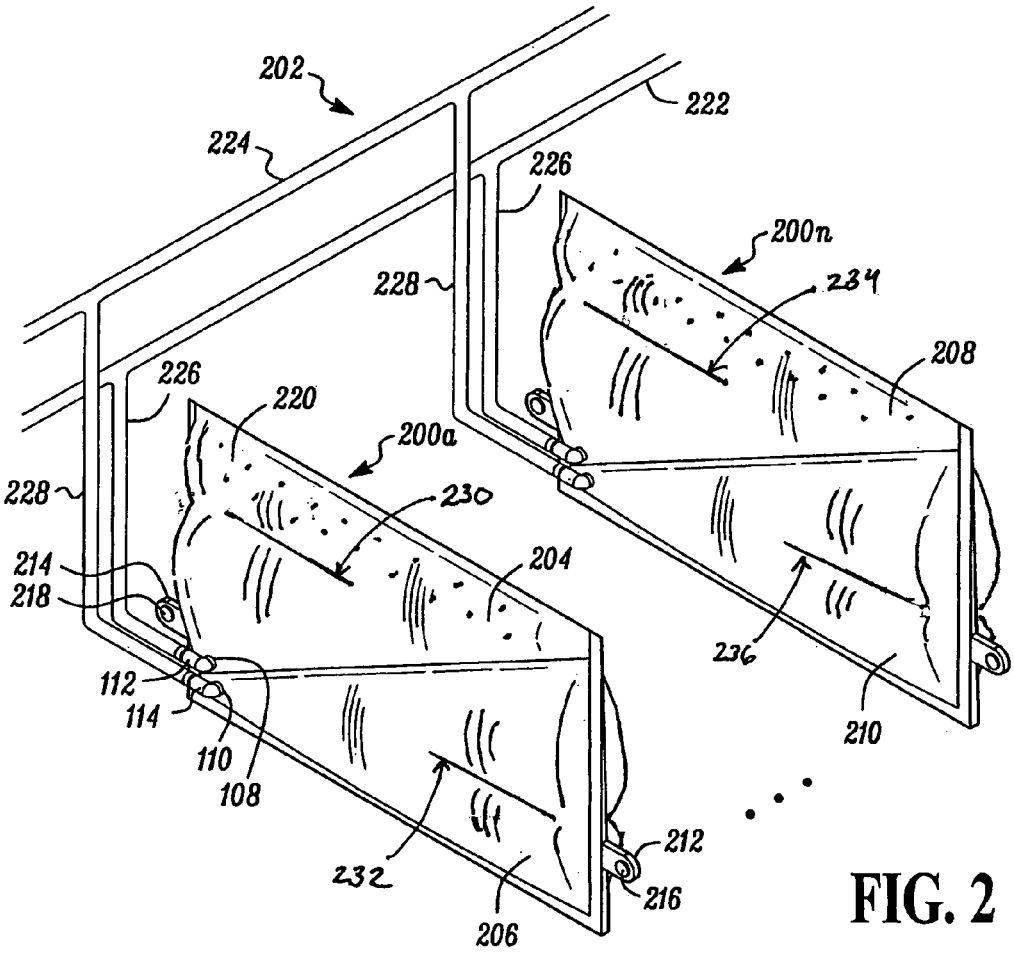
FIG. 2 is a side perspective view of a series of inflatable cushion cells, in accordance with one embodiment of the invention.

FIG. 2 illustrates a series of inflatable cushion cells, 200*a* to 200*n*, and a fluid passageway system 202. The inflatable cushion cells 200*a* to 200*n* are similar to the inflatable cushion cell 100 shown in FIG. 1. As shown here however, the inflatable cushion cells, 200*a* to 200*n*, are shown containing a high pressure in each of the following: the first cell first inflatable compartment 204, the first cell second inflatable compartment 206, the second cell first inflatable compartment 208 and the second cell second inflatable compartment 210. In addition, securing tabs, 212 and 214, are also shown. Securing tabs 212 and 214 are used to secure each inflatable cushion cell to a frame (not shown) as known in the art. The securing tabs, 212 and 214, contain snaps, 216 and 218, or other securing devices, that allow them to be firmly attached to the frame and prevent the inflatable cushion cells 100 from moving out of place. Such tabs are particularly useful when the inflatable cushion cells 100 are deflated and therefore lack the support from one another as experienced when they are all inflated within the frame.

As used, the frame is typically accompanied by a frame base and a frame cover (patient support system cover). For those frames that are inflatable, such frames may be made out any suitable fluid resistant materials such that pressurized fluid may be maintained therein. The frame cover is typically made out of a canvas-type material, but may be made out of any suitable material used to separate the patient from the inflatable cushion cells, 200*a* to 200*n*, and/or the frame.

In this embodiment, inflatable cushion cells, 200*a* to 200*n*, are also shown to contain low air loss holes 220. Such low air loss holes 220 are useful in providing certain types of therapies directed to patient skin care. Such low air loss holes 220 are comparatively small, for example, 0.010 through 0.063 inches in diameter, or any other suitably sized hole that would be suitable to provide such therapies. Other embodiments do not include such low air loss holes 220.

In this embodiment, the fluid passageway system 202 allows fluid to be transferred to the series of inflatable cushion cells 200*a* to 200*n*. In one embodiment the fluid passageway system 202 is composed of tubing or hose like structure. In this embodiment a first fluid passageway 222 is provided for containing the fluids that are transferred to and from both the first cell first inflatable compartment 204 and second cell first inflatable compartment 208. In addition, this embodiment also includes a second fluid passageway 224 for containing the fluid that is transferred to and from both the first cell second inflatable compartment 206 and the second cell second inflatable compartment 210. In addition, in this embodiment a first feeder fluid passageway 226 is shown connecting the first fluid passageway 222 to the first fluid opening stem 112. Also, second feeder fluid passageways 228 are shown connecting the second fluid passageway 224 to the second fluid opening stem 114.

In addition, in one embodiment, each of the first cell first inflatable compartment 204, the first cell second inflatable compartment 206, the second cell first inflatable compartment 208 and the second cell second inflatable compartment 210, have a corresponding restriction members 230, 232, 234 and 236. Such restriction members 230, 232, 234 and 236 restrict the inflation or expansion of the corresponding external walls associated with the corresponding inflatable compartments. In one embodiment, such restriction members 230, 232, 234 and 236 allow for the expansion in a greater vertical direction by reducing the expansion in the width direction. In another embodiment, the restriction member reduces the contact between the series of inflatable cushion cells 200*a* to 200*n*. In one embodiment the restriction members 230, 232, 234 and 236 are in the form of a seal attaching external walls 116 and 118. Other embodiments use other mechanisms to form such restriction members.

Figure 3:
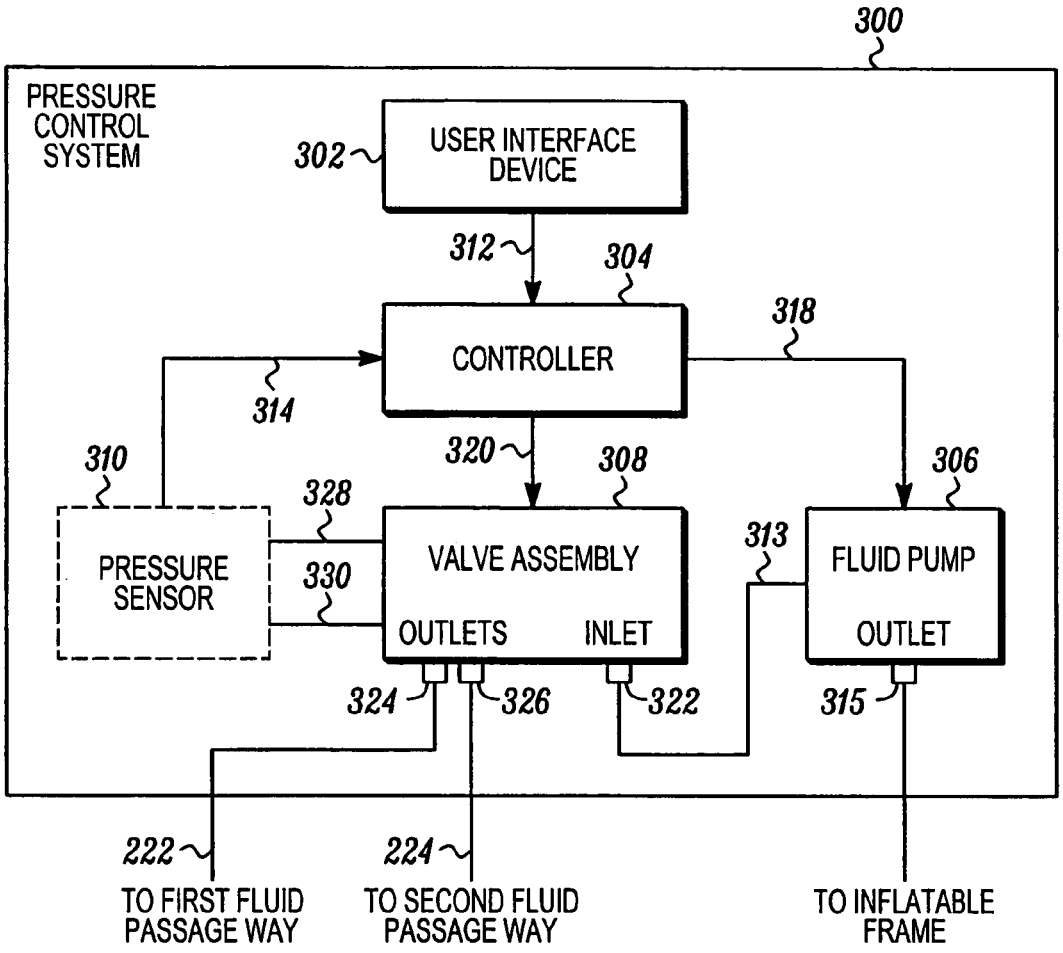
FIG. 3 is a block diagram of a pressure control system, in accordance with one embodiment of the invention.

FIG. 3 illustrates a pressure control system 300 used to control the inflation and deflation of the first and second inflatable compartments 102 and 104. In the embodiment shown, the pressure control system 300 includes the following components: a user interface device 302, a controller 304, a fluid pump 306, a valve assembly 308 and an optional pressure sensor 310 or multiple optional pressure sensors 310. In one embodiment, the user interface device 302 allows a user to input a desired pressure setting for the corresponding first and second inflatable compartments, 102 and 104. The user interface device 302 transmits signals 312 to controller 304. Such user interface device 302 can include light emitting diodes (LEDs), liquid crystal diodes (LCDs) either graphic or character based, seven segment displays, or other indication means, as well as various switches for selecting and setting up functions on the pressure control system 300 or any other suitable user interface. The user interface device can include any one or more different types of input devices, including, but not limited to, buttons, sensors, keypads, voice activation circuits or other like devices used to receive user interaction. In one embodiment pressure settings include separate settings for both the first and second inflatable compartments, 102 and 104. In one embodiment the actual pressure level amounts can be dialed up or entered in such that specific pressures for each inflatable compartment is specifically controlled. In another embodiment the user interface device 302 provides for the input of a request for a comfort related setting such as 'firm' or 'soft' where the pressure control system 300 responds by controlling the system pressure to correspond to programmed first and second inflatable compartment pressures that provide such corresponding comfort levels. In another embodiment, 'remove activation,' 'control,' and 'monitoring' may also be provided.

In another embodiment, where the first and second compartments are used to turn a patient resting thereupon, the user interface device 302 allows for the input of specific angles for which the patient is to be rotated. In another embodiment, the user interface device 302 provides for the input of a request for specific preprogrammed angles of rotation or corresponding rotations of the patient such as '¼,' '½,' '¾' and 'full.' One embodiment provides for the input of whether no turn, a left turn, a right turn or both a left and a right turn should be performed. Another embodiment provides for the selection of a mode that automatically performs a rotation of the patient based on a selected period of time. For example, the user interface device 302 may provide for the selections of '10,' '20,' '30' and '60' minutes. Such feature provides the benefit of not requiring that a patient service provider be present when the rotation occurs, thus freeing up the time for the patient service provider to perform other tasks. Other embodiments also include inputs for the rate at which a turn of the patient is to occur. Here, the pressure control system 300 controls the rate at which the fluid pump fills the first and second inflatable compartments, 102 and 104.

In one embodiment, fluid pump 306 is used as a fluid source for providing fluid to the series of inflatable cushion cells 200*a* to 200*n*. In one embodiment, fluid pump 306 is attached to valve assembly via fluid line 313. In one embodiment, fluid pump has an outlet 315 for providing fluid to a frame. In one embodiment the fluid source is non-powered. Depending on the embodiment, the fluid pump 306 can be a blower for blowing a gas or a liquid pump for pumping a liquid, or any other fluid source that provides fluid to the system and that can be used to inflate the first and second inflatable compartments, 102 and 104. In one embodiment the fluid pump 306 controls the flow of liquid, such as water or other liquid substance, into the first and second inflatable compartments, 102 and 104. In another embodiment, where the fluid is a liquid rather than a gas, the pressure control system 300 monitors the volume of fluid pumped into and our of the first and second inflatable compartments, 102 and 104, rather than monitoring a corresponding gas pressure.

In addition, depending on the embodiment, the fluid pump 306 may run constantly, or may run intermittently. In one embodiment, the fluid pump 306 is controlled to run constantly and operates to provide additional fluid to the first and second inflatable compartments, 102 and 104, only as necessary. In another embodiment, the fluid pump 306 only operates when the system requires additional pressure for the first and second inflatable compartments, 102 and 104. In addition, the fluid pump 306 may operate in an intermittent fashion in conjunction with the valve assembly 308 described below, such that relatively small amounts of additional pressure may be provided to the first and second inflatable compartments, 102 and 104, by selectively operating the fluid pump 306 and valve assembly 308 to provide only a portion of the fluid otherwise supplied by the fluid pump 306 in a full alternating pressure (A/P) cycle. In other embodiments, the fluid pump 306 used may be any suitable pump known by those of ordinary skill in the art to provide the fluid pressure as described.

In one embodiment, controller 304 is used to control the fluid pump 306 and the valve assembly 308 based on signals, 312 and 314 received from the user interface device 302 and an optional pressure sensor 310. In response to the signals it receives, and based upon logic contained in the controller 304 in the form of software executing on a suitable microprocessor, controller 304 generates signals, 318 and 320, to the fluid pump 306 and the valve assembly 308. In one embodiment the controller 304 receives a signal 312 from the user interface device 302, and based upon that signal, selectively sends a signal, 318 and 320, to either the fluid pump 306 or the valve assembly 308 to either provide additional fluids to the first and second inflatable compartments, 102 and 104, or to provide for the release of fluids from such compartments. In one embodiment the fluid pump 306 is used to both provide and remove fluids to the first and second fluid inflatable compartments, 102 and 104. In another embodiment, the fluid pump 306 is not used to remove fluids, instead the valve assembly 308 is simply sent instructions to open its valves to allow the fluid in the first and second inflatable compartments, 102 and 104, to escape under the pressure existing in such fluid. The controller may also be discrete logic or any suitable combination of hardware, software and firmware, such as that found in model K-4, Alternating Pressure/Low Air System as sold by Kap Medical.

In one embodiment, a valve assembly 308 is used to control the inflow and outflow of fluids to and from the first and second inflatable compartments, 102 and 104. In one embodiment, the valve assembly 308 contains one inlet 322 and at least two outlets, 324 and 326. The first outlet 324 is connected to a first fluid passageway 222 that is in fluid communication with the first inflatable compartments 102. A second outlet 326 is connected to a second fluid passageway 224 that is in fluid communication with the second inflatable compartment 104. The valve assembly 308 further includes a slide (not shown) that can be positioned such that it covers partially or fully, either one or both of the first and second outlets. In one embodiment a stepper motor (not shown) is used to control the movement of the slide. The slide is positioned such that both valves are open and are in fluid communication with one another such that the pressure in both the first and second inflatable compartments, 102 and 104, are equal. Alternatively, the slide may be positioned to fully cover the first outlet 324 and to not fully cover the second outlet 326, thereby, isolating a low pressure in the first inflatable compartment 102, while at the same time providing fluid communication between the second inflatable compartment 104 and the fluid pump 306 whereby a high pressure is achieved in the second inflatable compartment 104. In other embodiments, the valve assembly 308 used may be any suitable fluid control mechanism known by those of ordinary skill in the art to provide the fluid control as described.

The pressure in the inflatable compartments, 102 and 104, is controlled differently in different embodiments. In one embodiment the pressure is controlled via the use of a pressure sensor 310. In another embodiment the pressure is controlled without the use of a pressure sensor 310 where the high pressure is controlled to the target inflatable compartments, 102 and 104, by adjusting the fluid pump 306 to a particular speed, and corresponding fluid flow, which is preset to provide a particular corresponding pressure. This fluid flow may be a pre-set factory setting previously determined or may be otherwise adjustable. In the same embodiment the low pressure is controlled by use of a valve assembly 308 utilizing a stepper motor, or other like means for controlling one or more slides that control flow to corresponding outlets 324 and 326.

For those embodiments that use a pressure sensor 310, the pressure sensor 310 is used to detect the pressure in the associated inflatable compartments, 102 and 104. The pressure sensor is connected to the valve assembly 308 via a first fluid line 328 and a second fluid line 330. The first fluid line 328 is in fluid communication with the first inflatable compartment 102. The second fluid line 328 is in fluid communication with the second inflatable compartment 102. Depending on whether the pressure sensed is higher, lower or equal to the desired pressure, and if determined necessary, the pressure control system 300 will operate to increase or decrease such pressure to reach the desired pressure. In one embodiment, the pressure sensor 310 is located where the pressure control system 300 interfaces with such inflatable compartments, for example, where the output of the pressure control system 300 attaches to the fluid passage that connects with the first compartment. In one embodiment pressure sensor 310 is a piezo pressure sensor 310. In other embodiments, the pressure sensor used may be any suitable pressure detection mechanism known by those of ordinary skill in the art to provide the detecting of fluid pressures as described.

In another embodiment, a pressure sensor 310 is used to determine if the pressure control system 300 is connected to a first and/or second inflatable compartment, 102 and 104. In one such embodiment the pressure control system 300 determines that such an inflatable compartment, 102 and 104, is not attached where after a period of time has elapsed where an attempt to increase the pressure in a corresponding inflatable compartment, 102 and 104, does not result in an associated rise in pressure as detected by the pressure sensor 310. In another such embodiment, the pressure control system 300 determines that an initially attached inflatable compartment has be detached where an unexpected loss of pressure, (i.e., a loss that does not correspond to the settings of the pressure control system 300), is detected by the pressure sensor 310. In addition, in one embodiment, the pressure control system 300 is also used to provide fluid pressure to an inflatable frame. Here, an additional fluid passage is connected between the pressure control system 300 and the frame. In one embodiment the fluid pressure provided is at a constant unchangeable setting. In other embodiments an adjustable pressure setting may be provided to control the pressure maintained in the frame.

In one embodiment, the pressure control system 300 provides four separate modes: static, pulsating, alternating or turning. In the static mode the two first and second inflatable compartments, 102 and 104, are held at a constant same or similar pressure. For example, both compartments, 102 and 104, can be held at a high pressure. In this case, the top of the patient support system, or first inflatable compartment base 120, is held in a substantially horizontal position. In the alternating pressure mode or turning mode, one of the two inflatable compartments, 102 and 104, is kept at a high pressure while the other is kept at a low pressure. Here, the top of the patient support system is angled towards either a first or second side of the patient support system. In the alternating mode the first and second inflatable compartments, 102 and 104, alternate containing the high and low pressures. Here, the top of the patient support system alternates its angle towards both the first and second sides of the patient support system.

In the static mode the pressure in both inflatable compartments, 102 and 104, are held at a common pressure. The common pressure may be adjusted to a preferred level. The preferred level of pressure may be based upon either a therapy perspective, or may be determined by a level of comfort as experienced by the patient.

In the pulsating mode the two first and second inflatable compartments, 102 and 104, have their pressure simultaneously periodically dropped. For example, both compartments, 102 and 104, can have their pressure dropped by a factor of fifty percent for a duration of thirty seconds after the expiration of a repeating thirty second period. In another embodiment, the pressure is dropped by a factor of twenty five percent for a duration of ten seconds after the expiration of a sixty second repeating period.

Figure 4:
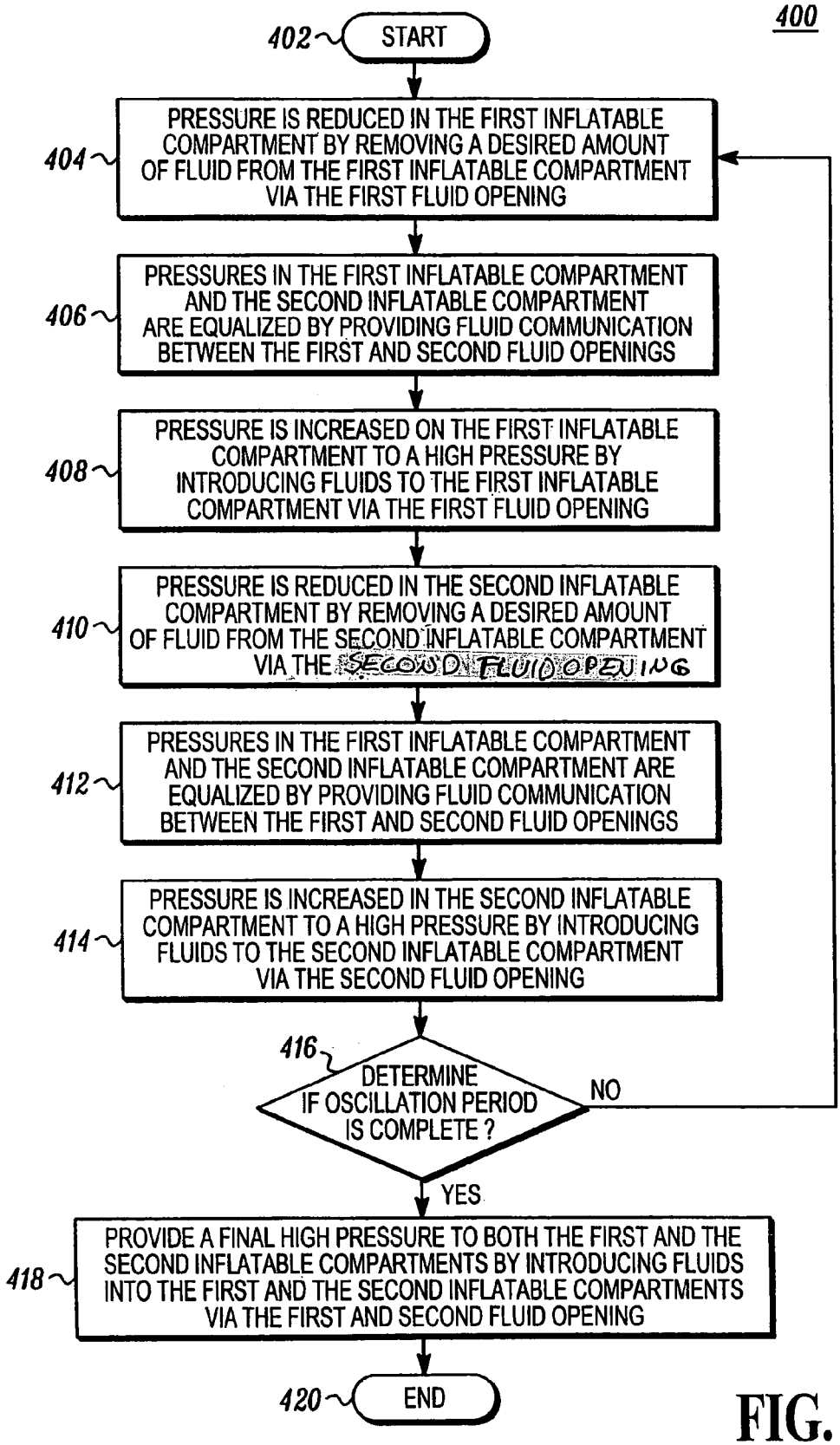
FIG. 4 is a flow chart illustrating one example of a method for moving a patient in an inflatable patient support system, in accordance with one embodiment of the invention.

In the alternating mode, and as described in FIG. 4 as method 400, the pressure control system 400 operates as follows. In step 404, after start step 402, fluid pump 306 is used in conjunction with the valve assembly 308 such that pressure is reduced in the first inflatable compartment 102 by removing a desired amount of fluid from the first inflatable compartment 102 via the first fluid opening 112. In another embodiment which inflatable compartment, 102 and 104, contains which pressure is reversed. Next, in step 406, the valve assembly 308 is used such that pressures in the first inflatable compartment 102 and the second inflatable compartment 104 are equalized by providing fluid communication between the first and second fluid openings, 108 and 110. In step 408, the fluid pump 306 is then used such that pressure is increased in the first inflatable compartment 102 to a high pressure by introducing fluids to the first inflatable compartment 102 via the first fluid opening 106. At the same time, or in succession, and in step 410, pressure is reduced in the second inflatable compartment 104 by removing a desired amount of fluid from the second inflatable compartment 104 via the second fluid opening 110. In one embodiment the low pressure is achieved using the fluid pump 306 to remove fluid from the first inflatable compartment. In another embodiment the low pressure is achieved by allowing the fluid to escape from the first inflatable compartment under its own pressure.

Next, and as described in step 412, the valve assembly 308 is used such that pressures in the first inflatable compartment 102 and the second inflatable compartment 104 are equalized by providing fluid communication between the first and second fluid openings, 108 and 110. Next, as describe in step 414, using fluid pump 306, pressure is increased in the second inflatable compartment 104 to a high pressure by introducing fluids to the second inflatable compartment 104 via the second fluid opening 110. At step 416 the controller 304 determines if oscillation period is complete, if it is not the process returns to step 404 to perform at least another full oscillation, if it is then step 418 is performed where the fluid pump 306 is used to provide a final high pressure to both the first and the second inflatable compartments, 102 and 104, by introducing fluids into the first and the second inflatable compartments, 102 and 104, via the first and second fluid openings, 108 and 110, and then ending step 420 is reached. As described above regarding the user interface device 302, a variety of settings may be utilized with this mode that effect when an oscillation will occur, the amount of angle of turn that a patient will experience, the speed at which the patient is turned, as well as other like settings having their corresponding effects.

The turning mode operates in a manner that is similar to that of the alternating mode, however, in contrast, there is not an automatic oscillation between which of the inflatable compartments, 102 and 104, contain the high pressure and which contains the low pressure. As such, one of the inflatable compartments, 102 and 104, is identified as the target compartment to receive the high pressure. Which of the two inflatable compartments is chosen as a target depends on which way the patient is desired to be rotated. As described above, the target compartment is set to a high pressure while the other compartment is set to a low pressure.

Figure 5:
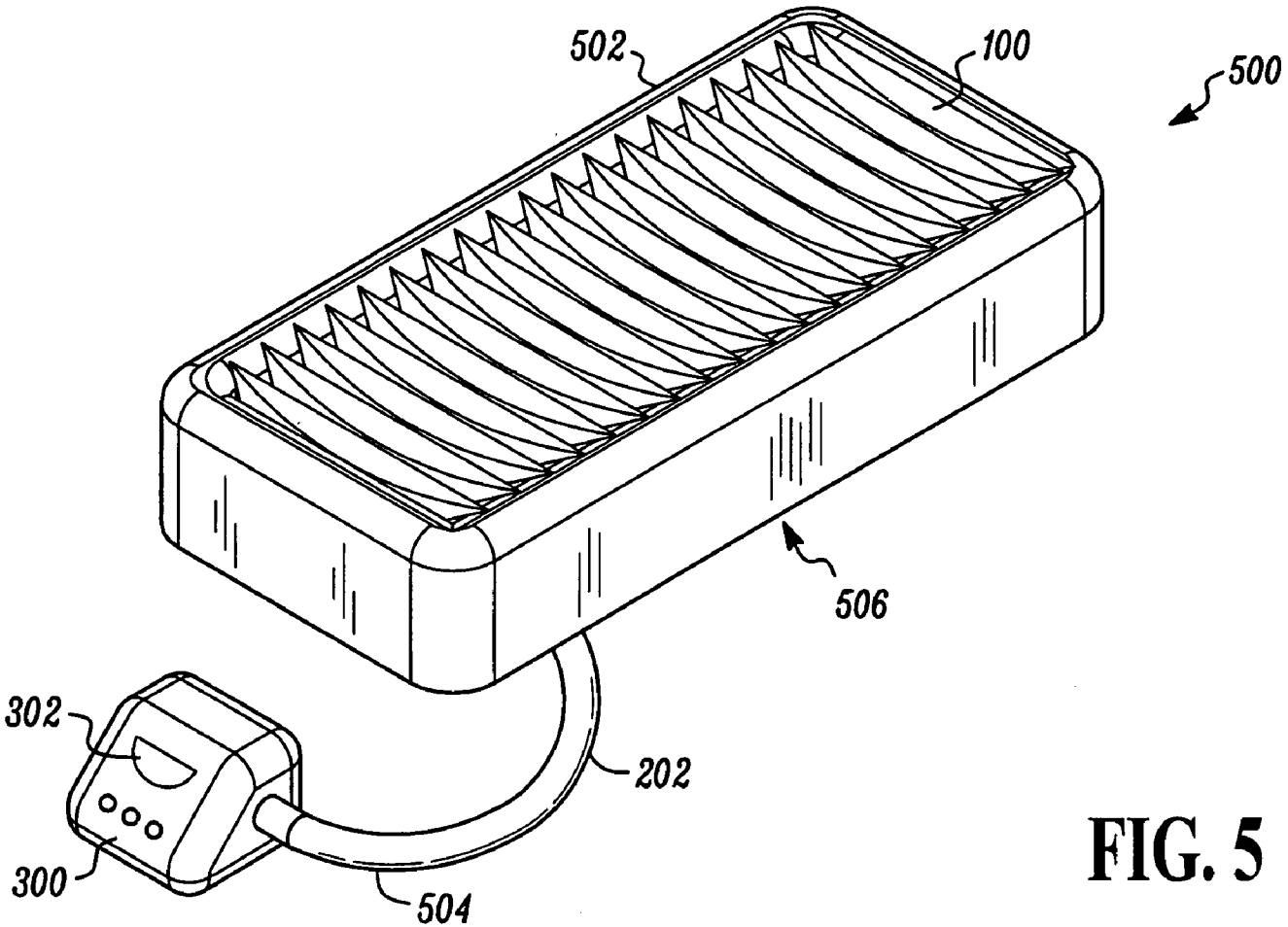
FIG. 5 is a front perspective view of an inflatable patient support system containing inflatable cushion cells and connected to a pressure control system, in accordance with one embodiment of the invention.

FIG. 5 illustrates an inflatable patient support system 500, containing a series of inflatable cushion cells 100 contained within a frame 502. Shown attached, via a tube 504, that contains the fluid passageway system 204, is pressure control system 300. Although not shown, the frame 502 includes a frame base 506 that extends throughout the open area between the frame 502. As shown, the frame 502, which in this embodiment is an inflatable frame, contains a series of inflatable cushion cells 100. The series of inflatable cushion cells 100 rest upon the frame base 504. As shown, the top of the inflatable cushion cells 100 are not attached to the frame 502, nor are such tops restricted. Although not shown, a patient support system cover is placed over what are shown here as exposed inflatable cushion cells 100 such that the skin of the patient does not contact such inflatable cushion cells 100. As described above in conjunction with the other figures, the series of inflatable cushion cells inflate and deflate in response to the operation of the pressure control system 300. In addition, as visible on the pressure control system 300, is the user interface device 302 is used to control the operation of the inflatable patient support system 500.

An advantage, among others, provided by one embodiment, is the use of a diagonal seal between external surfaces to define inflatable compartments. The use of a diagonal seal to segregate two inflatable compartments removes the need to place other types of barriers between the two inflatable compartment to achieve such a separation. As such, the seal nature of the diagonal seal means that fewer components are needed to define the two separate inflatable compartments. For example, no internal walls are needed. Likewise, similar seals may also be used to define the base, 120 and 126, and legs, 122, 130, 128 and 124, of a corresponding inflatable compartment, 102 and 104. Such advantages of using seals to define inflatable compartments therefore can provide the additional benefits of reduced manufacturing costs, materials costs, design costs, testing costs and shipping costs and other related benefits.

Another advantage, among others, provided by one embodiment, is the use of a frame 502 in conjunction with a series of inflatable cushion cells 100 where the top portion of the inflatable cushion cell 100 is free to move separately from the top of the frame 502. Here, at least, the inflatable cushion 100, upon deflation, is not restricted in its descent based on any connection of the top of the inflatable cushion 100 to a connection to the top of the frame 502.

Another advantage, among others, provided by one embodiment, is that an inflatable frame 502, used to secure the patient on the inflatable patient support system 500, has its internal fluid controlled independent of the internal fluids in the inflatable cushion cells 100. This allows one system directly dedicated to the controlling of the series of inflatable cushion cells 100, and another for controlling the frame 502.

As such, the advantage exists that the operational use of one inflation system, does not negatively impact the operational use of the other system.

In addition, yet another advantage provided by another embodiment, is the location of a diagonal seal 106 which is located such that it intersects the left and rights sides of the inflatable cushion 100 at a location below the top edge of the inflatable cushion 100 on one side, and above the bottom edge of the inflatable cushion 100 on the other side. Stated another way, the diagonal seam is offset from the corners of the cell. Hence a corner seal and diagonal seal need not be formed at the same point.

It should be understood that the implementation of other variations and modifications of the invention and its various aspects will be apparent to those of ordinary skill in the art, and that the invention is not limited by the specific embodiments described. For example, the steps described above may be carried out in any suitable order. It is therefore contemplated to cover by the present invention, all modifications, variations, or equivalents that fall within the spirit and scope of the basic underlying principles disclosed and claimed herein.

What is claimed is:

1. An inflatable cushion cell comprising:

first and second inflatable compartments defined at least in part by at least one diagonal seal structure;

wherein each compartment includes at least one fluid opening and wherein the cushion cell is non-annular.

2. The inflatable cushion cell of claim 1 wherein each compartment is further defined by first and second external side walls and wherein the diagonal seal structure connects the first and second external side walls to form fluid barrier between the first and second inflatable compartments.

3. The inflatable cushion cell of claim 1 wherein the first and second inflatable compartments each have at least one base surface and at least one leg surface located opposite the diagonal seal structure.

4. The inflatable cushion cell of claim 3 wherein at least one of the base surface and the leg surface is defined by a seal.

5. The inflatable cushion cell of claim 1 further comprising a restriction member located away from the diagonal seal structure wherein the restriction member is formed to restrict the expansion of the first and second inflatable compartments.

6. The inflatable cushion cell of claim 5 wherein the restriction member includes at least a first and second restriction member each located in each of the first and second inflatable compartments.

7. The inflatable cushion cell of claim 3 wherein the base of the first inflatable compartment contains low air loss holes that allow the contents of the first inflatable compartment to escape.

8. The inflatable cushion cell of claim 3 wherein the base of the second inflatable compartment contains low air loss holes that allow the contents of the first inflatable compartment to escape.

9. An inflatable cushion cell comprising:

first and second inflatable compartments defined by at least one diagonal seal structure, wherein each compartment includes at least one fluid opening, wherein the first and second inflatable compartments each have at least one base surface and at least one leg surface located opposite the diagonal seal structure, and wherein at least one of the base surface and the leg surface is defined by a seal; and a restriction member located away from the diagonal seal structure wherein the restriction member is formed as a seam to restrict the expansion of the first and second inflatable compartments.

10. The inflatable cushion cell of claim 9 wherein the restriction member includes at least a first and second restriction member each located in each of the first and second inflatable compartments.

11. An inflatable cushion cell defined by offset four corners comprising:

first and second inflatable compartments defined by at least one diagonal seal structure, wherein each compartment includes at least one fluid opening;

wherein the diagonal seal structure is offset from opposite corners of the cell.

12. The inflatable cushion cell of claim 11 wherein the intersection of the diagonal seal structure with a first vertical side of the inflation cushion cell define a first inflatable compartment first leg and a first inflatable compartment second leg, and wherein the intersection of the diagonal seal structure with a second vertical side of the inflation cushion cell define a second inflatable compartment first leg and a second inflatable compartment second leg.

13. An inflatable patient support system comprising:

a frame for securing inflatable cushion cells; and a plurality of inflatable cushion cells located within the frame;

wherein at least one of the plurality of inflatable cushion cells includes first and second inflatable compartments defined at least in part by at least one diagonal seal structure, and wherein each compartment includes at least one fluid opening.

14. The inflatable patient support system of claim 13 wherein at least two first inflatable compartments from at least two of the plurality of inflatable cushion cells are in fluid communication with one another, and wherein at least two second inflatable compartments from at least two of the plurality of inflatable cushion cells are in fluid communication with one another.

15. The inflatable patient support system of claim 13 wherein the frame is inflatable.

16. The inflatable patient support system of claim 13 wherein the first and second inflatable compartments of the at least one of the plurality of inflatable cushion cells each include at least one base surface located opposite the corresponding diagonal seal structure, wherein the at least one base surface of the first inflatable compartment is located above the at least one base surface of the second inflatable compartment, and wherein the at least one base surface of the first inflatable compartment is substantially horizontal when both the first and second inflatable compartments are at a high pressure, wherein the at least one base surface of the first inflatable compartment slopes in a first direction when the first inflatable compartment is at a low pressure and the second inflatable compartment is at a high pressure, and wherein the at least one base surface of the first inflatable compartment slopes in a second direction when the first inflatable compartment is at a high pressure and the second inflatable compartment is at a low pressure.

17. A pressure control system for a first inflatable cushion cell having a first cell first inflatable compartment and a first cell second inflatable compartment, comprising:

a user interface device for selecting desired pressures for the first cell first inflatable compartment and the first cell second inflatable compartment;

a fluid pump for increasing or decreasing the pressures in the first cell first inflatable compartment and the first cell second inflatable compartment;

a valve assembly for selectively providing fluid communication to the first cell first inflatable compartment and the first cell second inflatable compartment; and a controller for controlling the operation of the fluid pump and the valve assembly based on input from the user interface device;

wherein the first cell first inflatable compartment and the first cell second inflatable compartment are defined at least in part by at least one diagonal seal structure, and wherein each of the first cell first inflatable compartment and the first cell second inflatable compartment include at least one fluid opening.

18. The pressure control system of claim 17 further comprising pressure sensors for detecting pressures of the first cell first inflatable compartment and the first cell second inflatable compartment.

19. The pressure control system of claim 17 wherein the controller is operative to power on the fluid pump intermittently.

20. The pressure control system of claim 17 further comprising a second inflatable cushion cell having a second cell first inflatable compartment and a second cell second inflatable compartment, wherein the second cell first inflatable compartment and the second cell second inflatable compartment are defined by at least one diagonal seal structure, and wherein the second cell first inflatable compartment and the second cell second inflatable compartment include at least one fluid opening, and wherein the first cell first inflatable compartment is in fluid communication with the second cell first inflatable compartment, and wherein the first cell second inflatable compartment is in fluid communication with the second cell second inflatable compartment.

21. An inflatable patient support system comprising:

an inflatable bed including:

a frame for securing inflatable cushion cells; and a plurality of inflatable cushion cells located within the frame;

wherein at least one of the plurality of inflatable cushion cells includes first and second inflatable compartments defined at least in part by at least one diagonal seal structure, and wherein each compartment includes at least one fluid opening, wherein each of the first inflatable compartments of the plurality of inflatable cushion cells are in fluid communication with one another; and wherein each of the second inflatable compartments of the plurality of inflatable cushion cells are in fluid communication with one another; and a pressure control system including:

a user interface device for selecting desired pressures for the first inflatable compartments and the second inflatable compartments;

a pressure sensor for detecting pressures of the first inflatable compartments and the second inflatable compartments;

a fluid pump for selectively increasing or decreasing the pressures in the first inflatable compartments and the second inflatable compartments;

a valve assembly for selectively providing fluid communication to the first inflatable compartments and the second inflatable compartments; and a controller for controlling the operation of the fluid pump and the valve assembly based on input from the user interface device and the pressure sensor.

22. The inflatable bed system of claim 21 wherein each of the plurality of inflatable cushion cells further includes: a first restriction member located away from the at least one diagonal seal structure wherein the first restriction member is formed as a seam to restrict the expansion of the first inflatable compartment; and a second restriction member located away from the at least one diagonal seal structure wherein the second restriction member is formed as a seal to restrict the expansion of the second inflatable compartment.

23. An inflatable cushion cell comprising:

first and second inflatable compartments defined at least in part by at least one diagonal seal structure, wherein each compartment includes at least one fluid opening; and a plurality of securing structures.

* * * * *